United States Patent [19]

Hirsig

[11] 3,934,517

[45] Jan. 27, 1976

[54] CABLE CONNECTION WITH SLACK CABLE-BRAKE RELEASE FOR AN AERIAL CABLEWAY

[75] Inventor: Emil Hirsig, Thun, Switzerland

[73] Assignee: Willy Habegger, Thun, Switzerland

[22] Filed: Nov. 11, 1974

[21] Appl. No.: 522,584

[30] Foreign Application Priority Data

Nov. 20, 1973 Switzerland ..... 16278/73

[52] U.S. Cl. ..... 104/173; 104/178; 104/183; 105/150; 254/175

[51] Int. Cl.[2] ..... B61B 7/02; B61B 12/06

[58] Field of Search ..... 104/89, 112, 114, 117, 104/173, 178, 183, 196, 179, 180; 254/175, 156; 242/45; 212/26, 27, 124, 86, 87, 88, 91, 94; 226/44; 105/150, 151

[56] References Cited

UNITED STATES PATENTS

| | | | |
|---|---|---|---|
| 2,462,972 | 3/1949 | Johnson | 254/175 |
| 2,685,373 | 8/1954 | Naud | 212/91 X |
| 3,472,343 | 10/1969 | Williams et al. | 254/175 X |
| 3,750,591 | 8/1973 | Makinster et al. | 104/112 |
| 3,809,832 | 5/1974 | Burger | 104/178 X |
| 3,854,407 | 12/1974 | Cocroft | 102/112 |

FOREIGN PATENTS OR APPLICATIONS

| | | | |
|---|---|---|---|
| 788,302 | 6/1968 | Canada | 104/183 |

*Primary Examiner*—Robert J. Spar
*Assistant Examiner*—Randolph A. Reese

[57] ABSTRACT

A cable connection with slack cable-brake release for an aerial cableway, wherein a traction cable and possibly a counter cable are secured to the travelling mechanism or carriage of the aerial cableway and a brake mechanism of the aerial cableway is automatically released by a brake release mechanism influenced by the cable traction upon decrease of the cable traction to a predetermined minimum value. The tensioned or traction cable is guided over a damping mechanism arranged at the travelling mechanism for overcoming the oscillations of the cable and after wrapping about a cable drum is attached to the travelling mechanism. The traction cable in an oscillation-free range is deflected by a force measuring device which for a predetermined value of the cable-contact force which is proportional to the cable traction brings about the response of the brake release mechanism.

11 Claims, 5 Drawing Figures

CABLE CONNECTION WITH SLACK CABLE-BRAKE RELEASE FOR AN AERIAL CABLEWAY

BACKGROUND OF THE INVENTION

The present invention relates to an improved construction of cable connection with slack cable-brake release at an aerial cableway wherein a traction cable and possibly a counter cable are secured to the travelling mechanism or carriage of the aerial cableway and the brake mechanism of the aerial cableway is automatically released by a brake release mechanism influenced by the tension or traction of the cable upon decrease of the cable traction to a predetermined minimum value.

The most important attachment means for wire cables are cast cable sleeves, collars, clamps and cable grommets of the most different constructions. These attachment means are also used at aerial cableways for connecting the tensioned or traction cable and counter cable to the travelling mechanism or carriage. In order to ensure for a satisfactory operational reliability, it is necessary that the aerial cableway be equipped with catch brakes which automatically and immediately are released when the cable traction or tension drops to a minimum value and especially upon disappearance of the tension in the cable owing to rupture of the cable. Simple, robust and positive means for determining the cable tension or traction are measurement springs (spring sets or packages) by means of which the cable traction can be converted into a proportional spring displacement. For the catch brakes there then can be provided brake release mechanisms which contain such measurement springs, wherein the spring displacement directly or indirectly determines the release criterium.

In the case of aerial cableways there is thus usually connected the traction cable and, if present, also the counter cable, while intermediately interposing a brake release mechanism containing a measuring spring arrangement, with one of the aforementioned attachement means at the travelling mechanism. The cable attachment (collars, clamps, grommets) and the measuring spring arrangement in this case accommodates the entire cable traction and must be appropriately dimensioned. The required dimensioning does not, however, have associated therewith any difficulties and also does not lead to increased costs. Additionally, there is to be characterized as advantageous the simple construction and small spatial requirements of this known cable connection with slack cablebrake release. However, these advantages are also counteracted by certain disadvantages, and specifically with regard to the cable attachment as well as the brake release. For the operational reliability the tension strength of the cable connection location is decisive. It is just the cable connection which, however, is markedly loaded mechanically and owing to the manipulations which occur for the attachment at the tension or traction cable such is rather sensitive to the influences of the surroundings. Thus, for instance, the cable, due to the continually present oscillations of the cable at the connection locations owing to the forced oscillations of the considerable collar mass due to the full load is subjected to bending loads, and the frequent temperature changes, water, ice and industrial waste gases easily lead to the formation of rust and changes in the structure of the material at the connection location, so that it is only possible to detect the presence of defects and faults from the surface properties of the connection location. Additionally, the expenditure in work is considerable as concerns shortening of the cable which is required at periodic intervals. The same is more or less also true for the measurement spring arrangement. The adjustment of the measurement springs, which are markedly dimensioned owing to the full load, to the release criterium is difficult and inaccurate and furthermore, pronounced cable oscillations can bring about erroneous release operations. Such heretofore known fully loaded cable connections with slack cable-brake release are accordingly associated with a certain unreliability which becomes greater with increasing load and in the case of fully-loaded cable installations leads to risks in safety.

SUMMARY OF THE INVENTION

Hence, it is a primary object of the present invention to provide an improved cable connection with slack cablebrake release for an aerial cableway which is not associated with the aforementioned drawbacks and limitations of the prior art constructions.

Another and more specific object of the present invention aims at the provision of a cable connection with slack cablebrake release wherein the aforementioned drawbacks are avoided and which also ensures for satisfactory safety in the case of heavily loaded aerial cableways.

Now in order to implement these and still further objects of the invention, which will become more readily apparent as the description proceeds, the invention contemplates that the traction cable is guided over a damping mechanism arranged at the travelling mechanism or carriage and which overcomes the oscillations or vibrations of the cable, and after wrapping about a cable drum is secured to the travelling mechanism. Further, the traction cable in an oscillation-free region is deflected by a force measuring device which for a predetermined value of the cable contact force which is proportional to the cable traction causes the brake release mechanism to respond. With the inventive cable connection with slack cable-brake release the cable attachment is completely relieved, and the force measuring device which detects the cable tension or traction via the cable deflection need only be dimensioned for a small deflection force which ensures for a positive release of the brake release mechanism. The cable attachment can be any known construction, preferably one allowing for an effortless shortening of the cable, and can be of light construction owing to the fact that it is extensively relieved. Similarly, for the force measuring device, which deflects the cable, there can be employed any known pressure- or tension measuring device. There is preferably however used a two-part deflection shoe, by means of which the cable is deflected out of the cable traction direction upwardly towards the cable drum, wherein the one deflecting shoe part or portion is constructed as an oscillation damper and the other deflecting shoe part or portion is pivotably mounted at one end about a stationary axis of rotation and with its free end acts upon a force measuring device. As the force measuring device there can be employed a measuring spring which is supported at one end at the travelling mechanism or carriage and at the other end at the pivotable deflection shoe portion. Advantageously, the deflection shoe portion which dampens the cable oscillations possesses a large deflection radius and the pivotable deflection shoe portion a small deflection radius. The deflection shoe portion which dampens the cable oscillations can be mounted at the travelling mechanism by means of a rubber elastic mounting or bearing and additionally the cable can be supported in front of this deflection shoe portion by means of a shock absorber. The deflection shoe is preferably covered with a plastic lining which possesses a groove for receiving the tension or traction cable. If the vehicle is equipped with a counter cable, then advantageously also the counter cable is guided over a dampening device, preferably of the same construction, and after wrapping about a cable drum, is secured at the travelling mechanism. The traction cable and the counter cable in this case can be wrapped oppositely about a common cable drum, so that there can be realised in a very simple manner a compensation of the cable tension or traction.

The invention is especially applicable for aerial cableways using a support or carrier cable.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
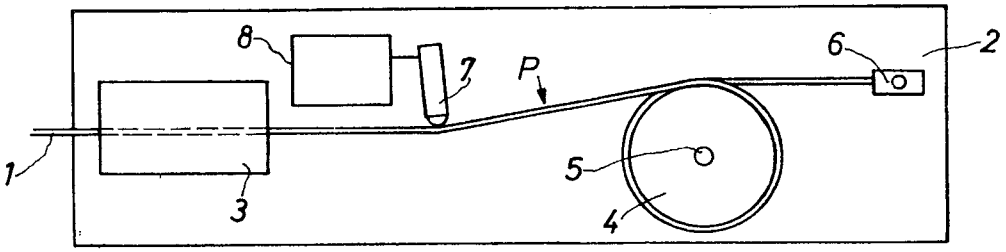
FIG. 1 is a schematic illustration of the principle construction of a cable connection with slack cable-brake release according to the invention.

Describing now the drawings, as shown in FIG. 1 with the exemplary cable connection with slack cable-brake release of this development the cable 1 is guided at the travelling mechanism or carriage 2 of the aerial cableway through the agency of a damping device 3 which eliminates cable oscillations or vibrations occuring during operation. This cable 1 leads to a cable drum 4 which is rotatably mounted at the travelling mechanism 2 for rotation about an axis of rotation or shaft 5 which is located in a horizontal plane and perpendicular to the infeed direction of the cable 1. Cable 1 is wrapped around the cable drum 4 a number of times and then secured by means of a conventional cable attachment or fastening means 6 at the travelling mechanism or carriage 2. In the oscillation free-range of the cable 1 there is disposed between the damping device 3 and the cable drum 4 a force measuring device 7 which deflects the cable 1 out of its direction. This force measuring device 7 measures the contact pressure which is proportional to the tension or traction of the cable 1 deflected out of its direction and at a predetermined value thereof, namely, the release criterium, releases the brake release mechanism 8. Since the cable 1 is first attached at the travelling mechanism or carriage after being wrapped around the cable drum 4, the cable attachment 6 is completely relieved when the cable drum 4 is blocked and accordingly can be constructed and arranged exclusively for a satisfactory resistance against the surrounding or ambient influences, can be easily controlled and the cable can be rapidly shortened. For rapid cable shortening the cable attachment can be constructed as a clamping head. Due to the deflection of the cable 1, which is practically free of oscillations during operation between the damping device 3 and the cable drum 4, by means of the force measuring device 7 there is obtained a force proportional to the cable tension or traction, the intensity of which is appropriately selected to the momentary requirements and can be considerably smaller than the traction force of the cable 1. As a result there are also realised advantages for the slack cable-brake release since the force measuring device can be constructed for an easy and exact adjustment of the release criterium, as well as likewise for a satisfactory resistance against the ambient effects and for good control purposes. Additionally, cable oscillations do not have any influence upon the brake release action.

A preferred exemplary embodiment of such cable connection with slack cable-brake release for an aerial cableway with tensioned or traction cable and counter cable will be described in detail hereinafter.

Figure 2:
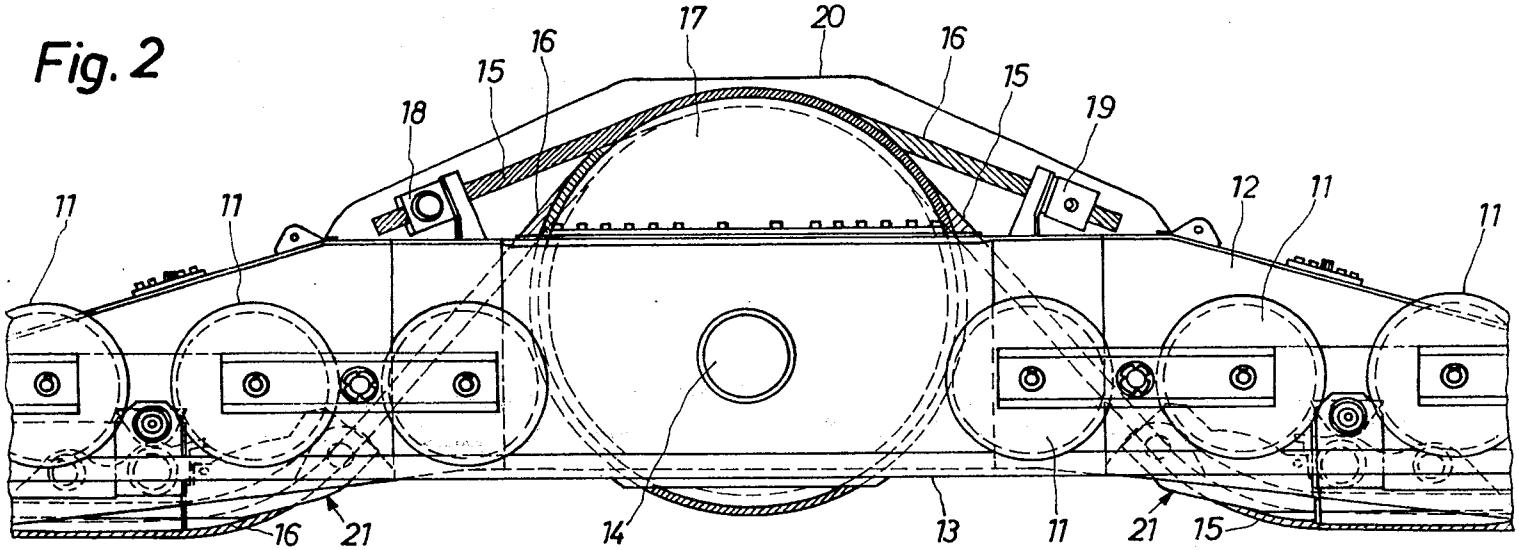
FIG. 2 is a side view of the travelling mechanism or carriage of an aerial cableway with support cable, the travelling mechanism containing for the traction cable and the counter cable a respective cable connection with slack cable-brake release according to a preferred embodiment.

The travelling mechanism or carriage illustrated partially in FIG. 2 will be seen to possess travelling rollers 11 which are mounted at a main carrier or support 12 and travel upon a carrier or support cable 13. In the lengthwise center of the main carrier 12 there is illustrated a carrier pin 14 which carries the pendulum arm with the cabin, both of which have not been illustrated as a matter of convenience.

Reference character 15 designates the traction or tension cable which drives the travelling mechanism or carriage and the cabin hanging thereat. This traction cable like the counter cable 16 is wound about a cable drum 17 which is centrally mounted in a recess of the main carrier or support 12. The ends of both the traction cable 15 as well as also the counter cable 16 are attached by means of clamping heads 18 and 19 respectively, at the main carrier or support 12. Owing to this arrangement the mounting of the cable drum 17 is not loaded by forces in the traction cable 15 and in the counter cable 16. Due to the described traction cable connection the strength of the traction cable is not reduced. Furthermore, the traction cable connection is protected by a covering 20 against damaging weather influences.

Figure 3:
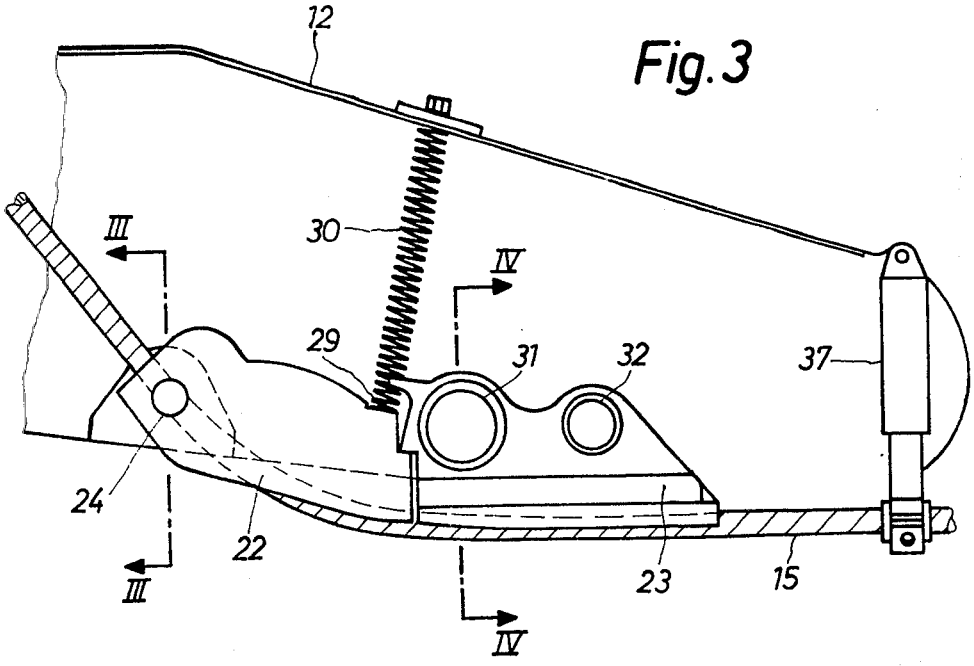
FIG. 3 is a side view of the cable connection with slack cable-brake release of FIG. 2.
Figure 4:
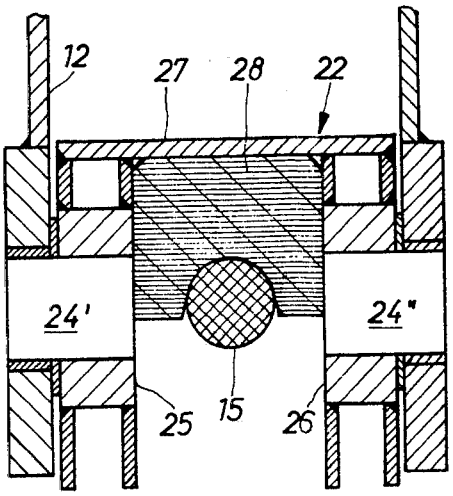
FIG. 4 is a cross-sectional view taken along the line III—III of FIG. 3.
Figure 5:
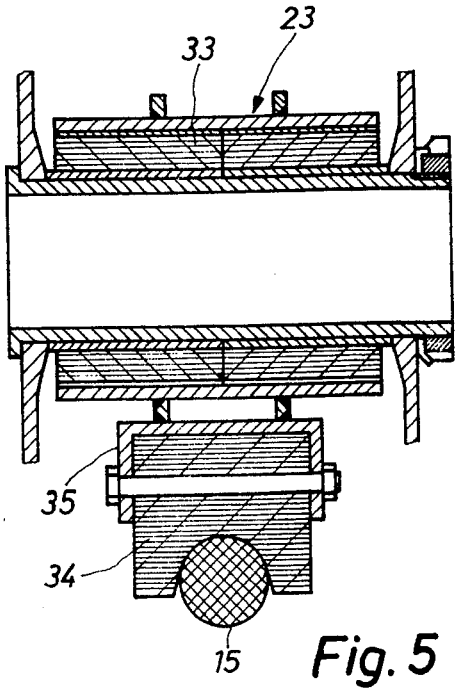
FIG. 5 is a cross-sectional view taken along the line IV—IV of FIG. 2.

Both the traction cable 15 as well as the counter cable 16, prior to running onto the cable drum 17, are guided over a twopart deflection shoe. Since this deflection shoe is identically constructed for both the traction cable and the counter cable it will only be described once for the traction cable 15 based upon the showing of FIGS. 3 to 5. The deflection shoe designated in FIG. 2 in its entirety by reference character 21 will be seen to comprise both deflection shoe components or parts 22 and 23. The deflection shoe part 22 is pivotably mounted about a pivot bearing 24 at the main carrier or support 12. As best seen in FIG. 4, the deflection shoe part 22, which is constructed as a welded structure and of U-shaped cross-sectional configuration, is designed with two legs 25 and 26, each of which takes up a pivot pin 24′ and 24″ of the pivot bearing 24. The space between both legs 25, 26 and the web 27 is lined with a plastic lining 28 which is equipped with a groove for receiving the traction cable 15. At the end of the deflection shoe portion or part 22 remote from the pivot bearing 24 such is equipped with a support surface 29 for a measuring spring, the brake release spring 30. This brake release spring 30 bears at its other end at the main carrier or support 12. The deflection shoe portion 22 cooperates with not particularly illustrated means for releasing a likewise not illustrated brake between the travelling mechanism or carriage and the support cable. The arrangement is undertaken such that the brake release spring 30, which is compressed together by the deflection force of the normally tensioned traction cable 15, when the cable is slack, for instance owing to cable rupture, rocks the deflection shoe portion 22 in the clockwise direction about the pivot bearing 24 and thus releases the means for actuating the brake.

The traction cable at the region shortly before the deflection tends in operation to oscillate. In order to prevent the bending stresses in the cable which are brought about by these oscillations, there is stationarily provided neighboring the deflection shoe portion 22 the other deflection shoe portion 23, however, connected so as to be resilient or to give at two points 31 and 32 with the main carrier or support 12. The resilient mounting, for instance at the bearing point 32, by means of a two-part rubber bushing or sleeve 33 can be recognized in FIG. 5. The deflection shoe portion 23 likewise has a U-shaped configuration when viewed in cross-section, and is equipped with a receiver having a plastic lining 34 and a groove intended to take-up the traction cable 15. This groove in the lengthwise direction (FIG. 3) has a comparatively large radius of curvature in order to maintain small the bending stresses in the cable, whereas the groove in the plastic liner 28 of the deflection shoe portion 22, at which region the cable practically does not oscillate or vibrate in operation, for reasons of space has a comparatively small radius.

For the additional damping of the traction cable oscillations the traction cable 15 is supported through the agency of a shock absorber 37 at the main support or carrier 12.

As mentioned, the counter cable 16 is guided over an identically constructed deflection shoe 21, so that during impermissible slackening or rupture of the counter cable 16 the brake is likewise automatically released. The traction cable 15 and the counter cable 16 are oppositely wound about the cable drum 17 which is mounted to be rotatable, so that there automatically occurs a compensation or balancing of the cable tension or traction.

While there is shown and described present preferred embodiments of the invention, it is to be distinctly understood that the invention is not limited thereto, but may be otherwise variously embodied and practiced within the scope of the following claims.

What is claimed is:

1. In an aerial cableway having a travelling mechanism, a traction cable secured to said travelling mechanism and a brake release mechanism operatively connected to said traction cable and operable in response to a drop of the tension in the traction cable below a predetermined minimum value, the improvement comprising: a damping mechanism arranged at said travelling mechanism, said traction cable being guided over said damping mechanism to counteract oscillations in said cable, a cable drum, said traction cable being wrapped around said cable drum and secured to said travelling mechanism, a force measuring device for deflecting the traction cable in an oscillation free-range thereof between said damping mechanism and said cable drum, said force measuring device being operatively connected to said brake release mechanism so as to cause said brake release mechanism to respond upon a predetermined value of the force of the cable exerted upon said force measuring device.

2. The combination as defined in claim 1, wherein said damping mechanism includes a two-part deflection shoe by means of which the cable is upwardly deflected towards the cable drum out of the cable traction direction, one deflection shoe part being constructed as an oscillation dampening device and the other deflection shoe part being pivotably mounted at a stationary axis of rotation and having a free end which acts upon the force measuring device.

3. The combination as defined in claim 2, wherein the force measuring device comprises a measuring spring which is arranged between the travelling mechanism and the free end of the pivotably mounted deflection shoe part.

4. The combination as defined in claim 3, wherein the deflection shoe part which dampens the cable oscillations possesses a large deflection radius and the pivotable deflection shoe part a small deflection radius.

5. The combination as defined in claim 2, wherein the deflection shoe part dampening the cable oscillations is mounted at the travelling mechanism through the agency of rubber-elastic mounting means.

6. The combination as defined in claim 2, wherein the cable which enters the deflection shoe is supported at the travelling mechanism by a shock absorber.

7. The combination as defined in claim 2, wherein the two-part deflection shoe is equipped with a plastic lining having a groove for receiving the cable.

8. The combination according to claim 1, in which said aerial cableway comprises a counter cable, a further damping mechanism, said counter cable being guided over said further damping mechanism, and a further cable drum secured to said travelling mechanism, said counter cable being wrapped around said further cable drum.

9. The combination as defined in claim 8, wherein the traction cable and the counter cable are wrapped in opposite directions about a common cable drum rotatably mounted about a shaft.

10. The combination as defined in claim 9, wherein the counter cable in the oscillation-free range is deflected by means of the force measuring device which for a certain value of the cable-contact force which is proportional to the cable traction causes the brake release mechanism to respond.

11. The combination according to claim 8, wherein said cable drum and said further cable drum form one single cable drum.

* * * * *